US012540483B2

(12) United States Patent
Lenox

(10) Patent No.: US 12,540,483 B2
(45) Date of Patent: Feb. 3, 2026

(54) POOL CLEANING DEVICE AND METHODS OF USE

(71) Applicant: Jay Lenox, Reading, MA (US)

(72) Inventor: Jay Lenox, Reading, MA (US)

( * ) Notice: Subject to any disclaimer, the term of this patent is extended or adjusted under 35 U.S.C. 154(b) by 677 days.

(21) Appl. No.: 17/888,123

(22) Filed: Aug. 15, 2022

(65) Prior Publication Data

US 2024/0052660 A1 Feb. 15, 2024

(51) Int. Cl.
*E04H 4/16* (2006.01)
*E04H 12/22* (2006.01)

(52) U.S. Cl.
CPC ..... *E04H 4/1609* (2013.01); *E04H 12/2292* (2013.01)

(58) Field of Classification Search
CPC .... A47L 13/44; A47L 13/256; A47L 15/0055; A47L 17/08; E04H 4/1609; E04H 12/2292
See application file for complete search history.

(56) References Cited

U.S. PATENT DOCUMENTS

| | | | | | |
|---|---|---|---|---|---|
| 960,158 | A * | 5/1910 | Cummings | A47L 13/44 | 15/247 |
| 1,360,926 | A * | 11/1920 | Glenn | A47L 13/44 | 15/247 |
| 1,773,734 | A * | 8/1930 | Kean | A47L 13/44 | 15/229.11 |
| 2,877,482 | A * | 3/1959 | Roy | A47L 4/02 | D4/137 |
| 2,942,287 | A | 6/1960 | Parmet | | |
| 5,042,105 | A * | 8/1991 | Buck | A47L 13/44 | 15/228 |
| 5,177,831 | A | 1/1993 | Wirth | | |
| 5,487,397 | A | 1/1996 | Bean | | |
| 6,668,413 | B2 | 12/2003 | Fortier | | |
| 7,409,740 | B1 | 8/2008 | Geigan | | |
| 8,117,707 | B1 | 2/2012 | Ruh, II | | |
| 8,707,503 | B2 | 4/2014 | Saccoccio | | |
| 11,028,608 | B2 | 6/2021 | Gerace | | |
| 2004/0060129 | A1 | 4/2004 | Juett | | |
| 2004/0177460 | A1 | 9/2004 | Wagner | | |
| 2014/0047655 | A1* | 2/2014 | Clayton | A47L 13/44 | 15/115 |
| 2016/0073849 | A1* | 3/2016 | Post | A47L 13/44 | 15/247 |

FOREIGN PATENT DOCUMENTS

| | | |
|---|---|---|
| WO | 2006074687 | 7/2006 |
| WO | 2008138427 | 11/2008 |

* cited by examiner

*Primary Examiner* — Andrew A Horton
(74) *Attorney, Agent, or Firm* — Lambert Shortell & Connaughton; David J. Connaughton, Jr.; Justin P. Tinger

(57) ABSTRACT

An improved pool cleaning device and methods of using the same are disclosed herein. The improved pool cleaning device generally comprises a cover for the attachment head of a pool cleaning pole. The device comprises fabric that completely encases the head and is fastened using at least one tie string and hook and loop patches. The methods of using the device comprise a method of mounting the device to an attachment head for a pool cleaning pole and a method of cleaning the device.

7 Claims, 10 Drawing Sheets

POOL CLEANING DEVICE AND METHODS OF USE

BACKGROUND

Technical Field

The present disclosure relates generally to an improved pool cleaning device and methods of using the same. More particularly the present disclosure relates to a cover for the attachment head of a pool cleaning pole comprising a fabric that completely encases the head and is fastened using at least one tie string and hook and loop patches.

Description of Related Art

There are millions of residential pools and spas in the United States, and hundreds of thousands, if not millions, of commercial pools and spas. Regardless of whether a pool is residential or commercial, cleaning and maintaining both the water and the surfaces within the pool is paramount for consistent use and enjoyment. Maintaining the water and surfaces within a pool requires an understanding of water chemistry, including, chlorine, pH, alkalinity, stabilizer, and salt levels. Additionally, knowledge of how filters, pumps, chlorinators, heaters, and other automated pool systems work is critical to pool maintenance. For example, pool algae infestations can be caused by poor water filtration, out-of-balance water pH, inconsistent chlorine levels, and the like.

However, even the cleanest of pools suffer from the problem of dirt, algae, or other sediment gathering on the surfaces of the pool, particularly, the pool floor. Known methods for mitigating or eliminating this problem have been unsuccessful. For example, even the best pool covers only prevent debris from settling at the bottom of a pool when the cover is on. When a cover is removed to use the pool, dirt and debris collected on the cover may fall into the pool or may be brought in by those swimming in the pool. Pool brushes, nets, and vacuums are also largely ineffective and time consuming because these devices tend to kick up sediment and move it to another area on the surface of the pool, instead of eliminating it.

In short, there are a plethora of problems associated with the cleaning of pools. Moreover, there are seemingly an equal or greater number of potential solutions to these problems. Therefore, what is needed is an improved pool cleaning device having the following characteristics and benefits over the prior art.

SUMMARY

The subject matter of this application may involve, in some cases, interrelated products, alternative solutions to a particular problem, and/or a plurality of different uses of a single system or article.

In one aspect, a device is disclosed. In this aspect the device comprises a fabric having a first portion and a second portion with stitches attached to the edges of the first portion and the second portion. The device also has a first face and a second face, and the first face has strings attached to the fabric by stitches. The device also has a button hole on either the first or the second portion.

In another aspect, a system is disclosed herein. In this aspect, the system comprises the device described in the previous aspect and an attachment head for a pool cleaning pole. The device is wrapped around the attachment head, and the attachment head is attached to the pool cleaning pole.

In yet another aspect, a method of using the device and/or system described in the previous aspects is disclosed. In this aspect, the method generally comprises the steps of aligning the button hole of the device with a stem of an attachment head for a pool cleaning pole. The stem is extended through the button hole, and the fabric of the device is wrapped around the attachment head. The strings of the device are then tied to provide lateral stability, and the stem of the attachment head is attached to the pool cleaning pole.

A method of cleaning the device is also disclosed. This method generally comprises reversing the steps disclosed in the previous aspect, followed by laying the device flat on a porous object, and spraying the device with water to allow sediment trapped in the fabric of the device to pass through the pores of the object.

It should be expressly understood that the various physical elements of the present disclosure summarized and further disclosed herein may be of varying sizes, shapes, or otherwise dimensions and made from a variety of different materials or methods of manufacture without straying from the scope of the present disclosure.

DETAILED DESCRIPTION

Figure 1:
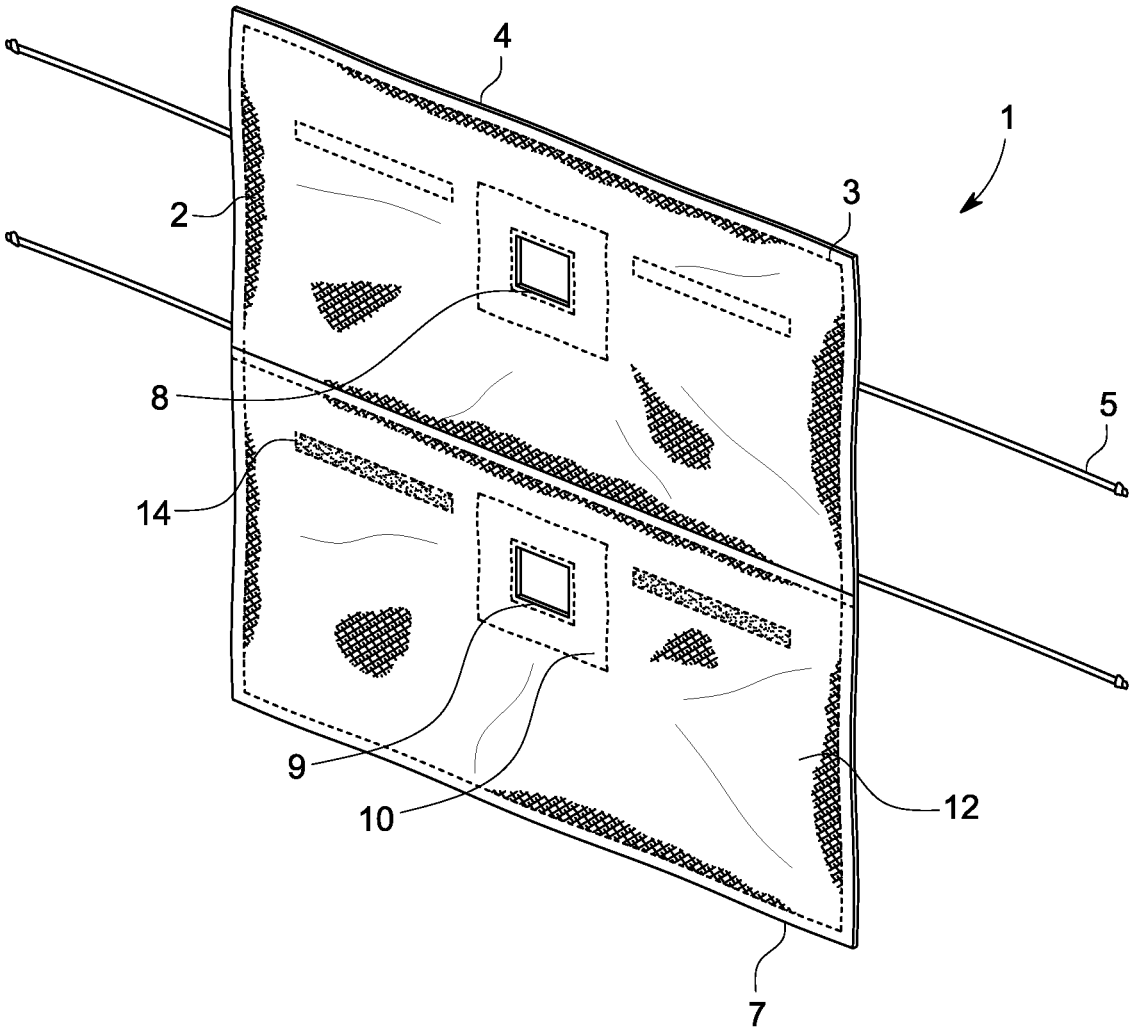
FIG. 1 provides an angled perspective view of an embodiment of the present disclosure.
Figure 2:
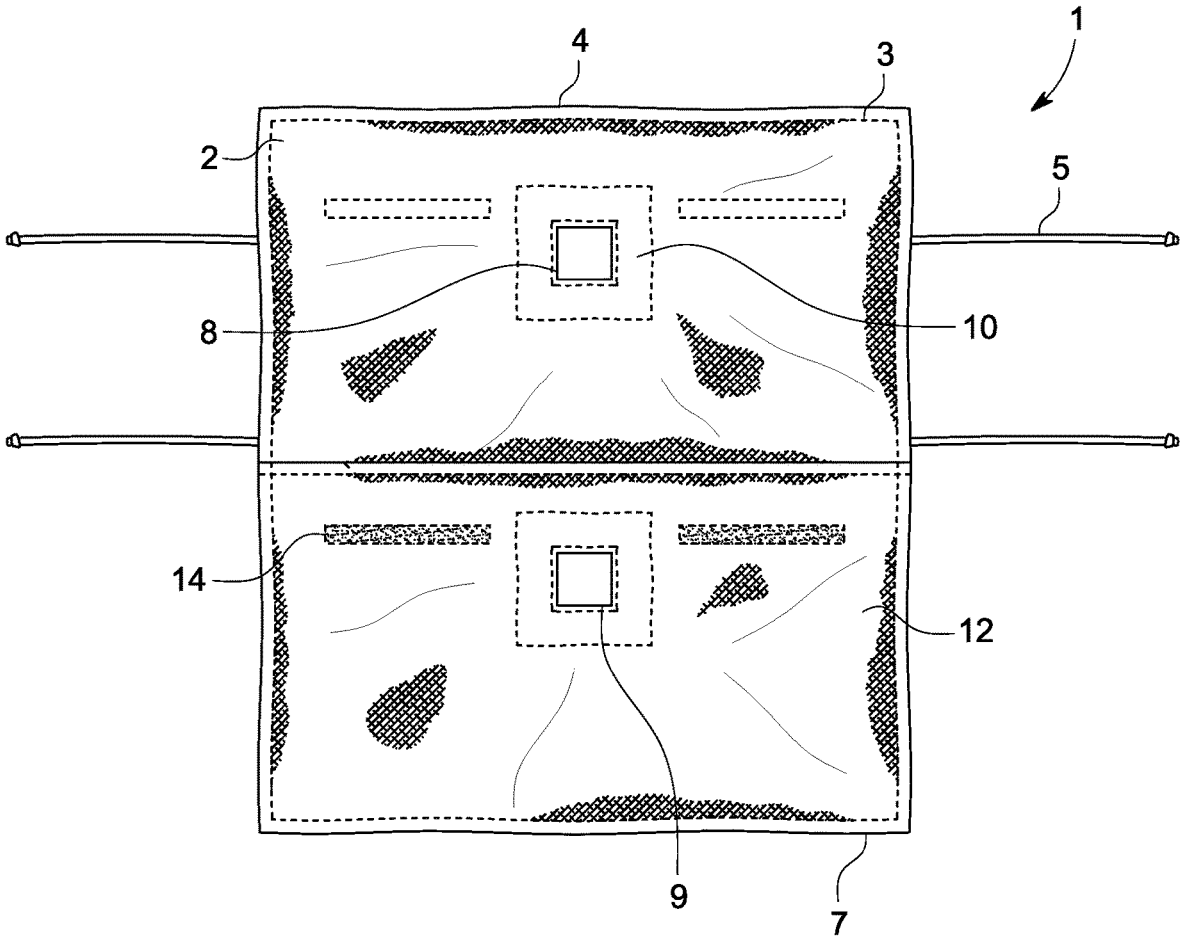
FIG. 2 provides a rear perspective view of an embodiment of the present disclosure.
Figure 3:
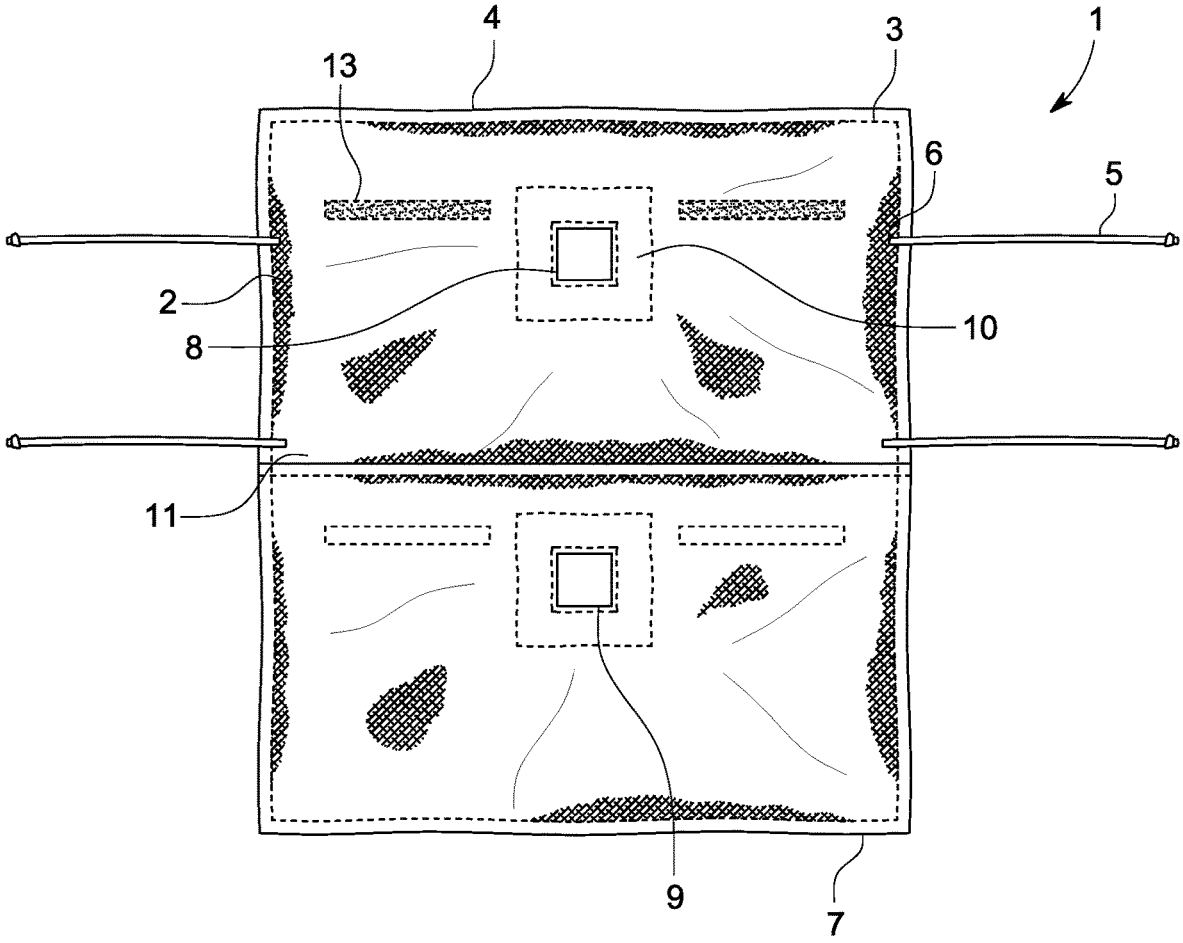
FIG. 3 provides a front perspective view of an embodiment of the present disclosure.
Figure 4:
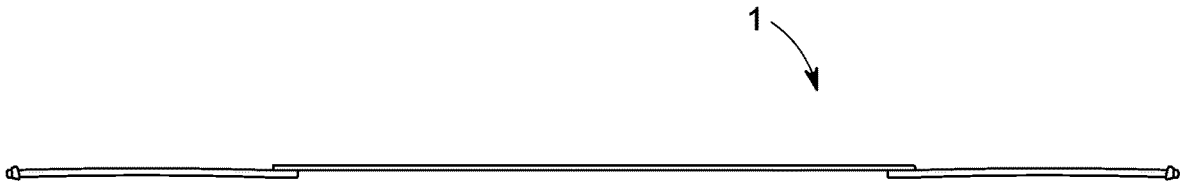
FIG. 4 provides a top perspective view of an embodiment of the present disclosure.
Figure 5:
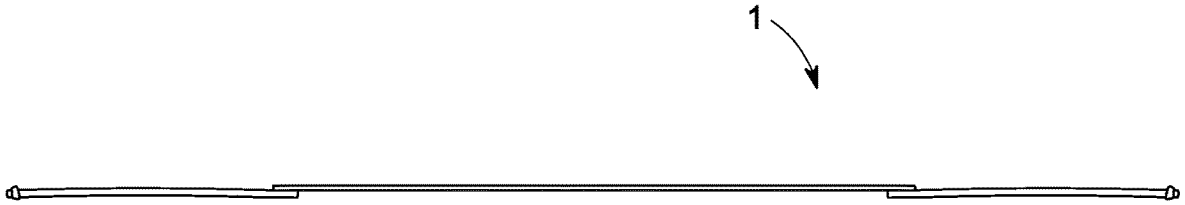
FIG. 5 provides a bottom perspective view of an embodiment of the present disclosure.
Figure 6:
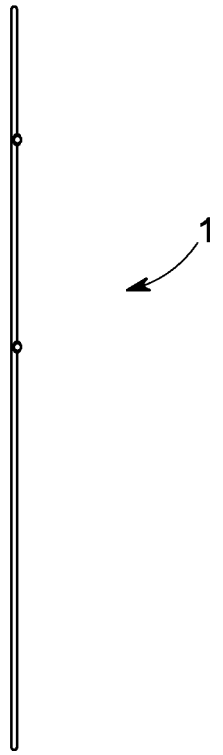
FIG. 6 provides a right side perspective view of an embodiment of the present disclosure.
Figure 7:
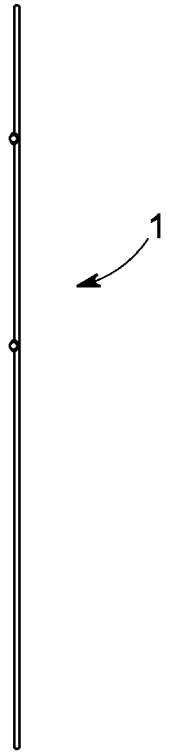
FIG. 7 provides a left side perspective view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a device for cleaning the surfaces of a pool. The present disclosure also concerns methods of using the device, particularly, the method of mounting the device to an attachment head for a pool cleaning pole. In a preferred embodiment, the device comprises a fabric material that completely encases the attachment head and is fastened using at least one tie string and at least one hook and loop patch, such as those produced by Velcro®. While the device disclosed herein may be advantageously used to effectively clean the surfaces within a pool, the embodiments described further herein may be used in other ways without straying from the scope of the present disclosure.

FIGS. 1-7 provide various perspective views of the preferred embodiment of the present disclosure. In this embodiment, the device 1 comprises a fabric material 2 held together by a plurality of stitches 3. The stitches 3 on the edge of the fabric 2 are particularly important, as these hold the device 1 together and prevent its unravelling despite repeated submerging and use of the device 1. Also, in this embodiment, a first, top portion 4 of the device 1 comprises a plurality of strings 5 attached to the fabric 2 by stitching 6. When tied, the strings 5 provide lateral stability for cleaning. Both the first, top portion 4 and a second, bottom portion 7 of the device 1 comprise a first button hole 8 and a second button hole 9, respectively. Both button holes 8 and 9 are reinforced by double seamed and double faced stitching 10, which causes the button holes 8 and 9 to be more stiff and secure than the rest of the surrounding fabric 2.

In addition to comprising two portions 4 and 7, the device 1 also comprises two faces, a front face 11 and a rear face 12. In the preferred embodiment, the top portion 4 on the front face 11 comprises two hook patches 13 secured to the front face 11 by stitching. The bottom portion 7 on the rear face 12 has two corresponding loop patches 14 also secured to the rear face 12 by stitching. When the device 1 is properly attached to an attachment head of a pool cleaning pole, the hook patches 13 mate with the loop patches 14 and provide vertical stability for cleaning. In embodiments that use hook and loop patches 13 and 14 for fastening of the device 1, it is important that the hook patches 13 are on the opposite face 11 or 12 of the device 1 than the loop patches 14; however, the exact location of the corresponding patches 13 and 14 on the faces 11 and 12 are not critical. Furthermore, in other embodiments, different fastening methods may be used without straying from the scope of the present disclosure (e.g., metal buttons, metal hooks and rings, and the like).

In one embodiment, the fabric material used for construction of the device may be a terry cloth or a towel-like fabric. The terry cloth or the towel-like fabric may comprise a plurality of micro loops on the surface of the fabric, which may aid in the cleaning capacity of the fabric. The micro loops may aid in the cleaning capacity of the fabric by providing a greater surface area to absorb or trap sediment. Another benefit of using terry cloth or towel-like fabric may be that it is highly durable and reusable. In other words, said fabric may be washed and dried a countless number of times without a decrease in cleaning capacity. Accordingly, the embodiments of the device that use such fabric may have an extremely long useful life (e.g., several years at least).

In the same embodiment or a different embodiment, fabrics having two different weights may be used in the construction of the device. For example, in one embodiment, a first portion of the device may comprise a lighter fabric than a second portion. In another embodiment, the fabric with the heavier weight may be sewn inside the lighter fabric. In either embodiment, the lighter fabric may be used as the scrubbing or cleaning surface of the device, and the heavier fabric may be used to absorb or trap stray dirt that is displaced and spread around during cleaning. The benefit of the heavier fabric may be similar to the benefit of the micro loops, namely, the heavier fabric may provide more mass for the absorption and trapping of sediment. In a preferred embodiment, the device may comprise an eighteen (18) ounce fabric, and a sixteen (16) ounce fabric. Moreover, having a weight differential between two fabrics used in the construction of the device may be considered critical for the reasons stated herein, namely, the provision of more mass for absorbing and trapping dirt, debris, and other sediment.

Figure 8:
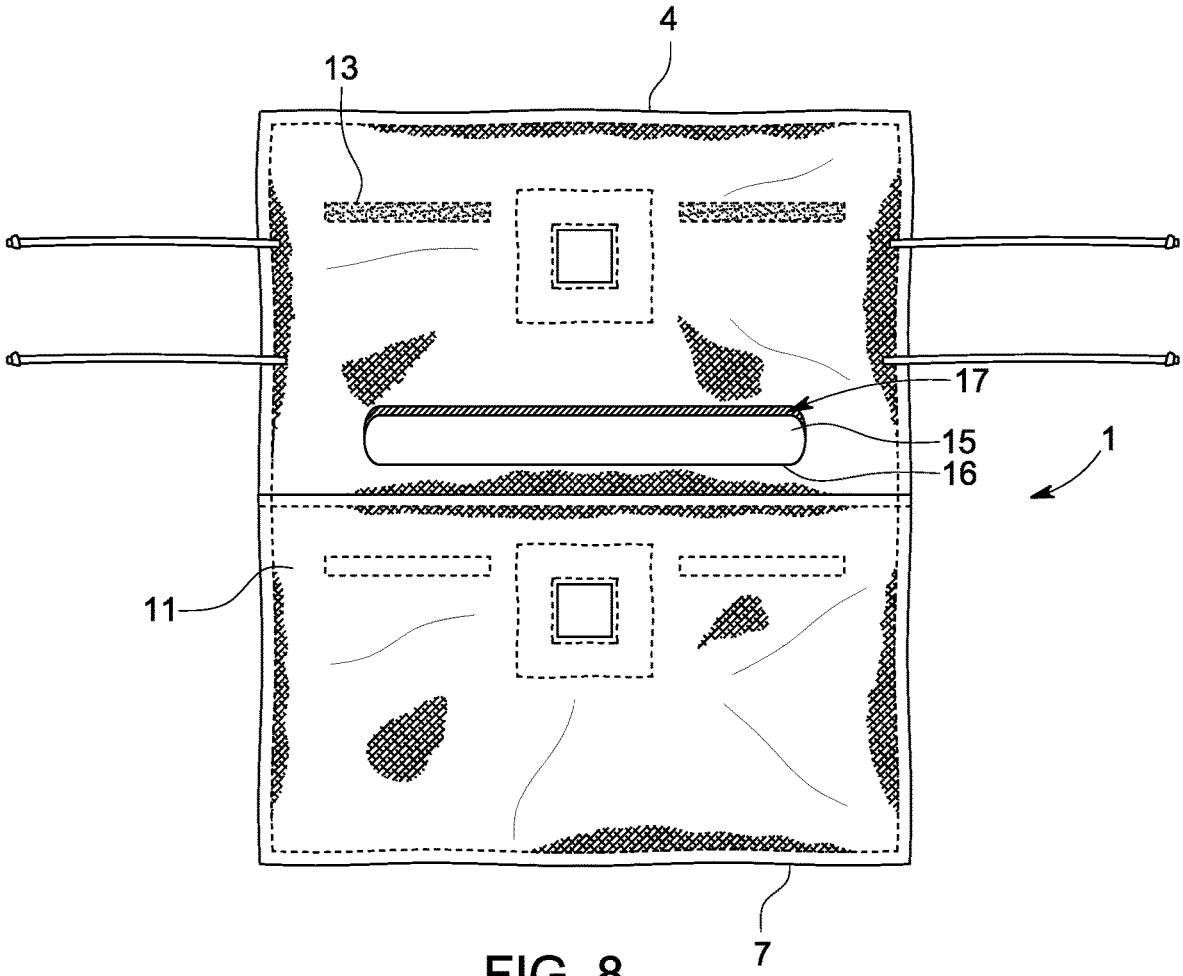
FIG. 8 provides a perspective view of another embodiment of the present disclosure.

In another embodiment, to improve cleaning capability, the device 1 is equipped with a pouch 15, as shown in FIG. 8. In this embodiment, the pouch 15 is secured to a first portion 4 of the device 1 by stitching 16, and the pouch 15 opens and closes via a zipper 17. The pouch 15 may be filled with cleaning chemicals or tabs before the device 1 is used to clean the surface of a pool, which may improve the effectiveness of the device 1 during cleaning. The pouch 15 may be secured and opened in other ways without straying from the scope of the present disclosure. For example, in other embodiments, the pouch 15 may be secured to both portions 4 and 7 of the device 1 and may be opened and sealed by hook and loop fasteners.

Figure 9:
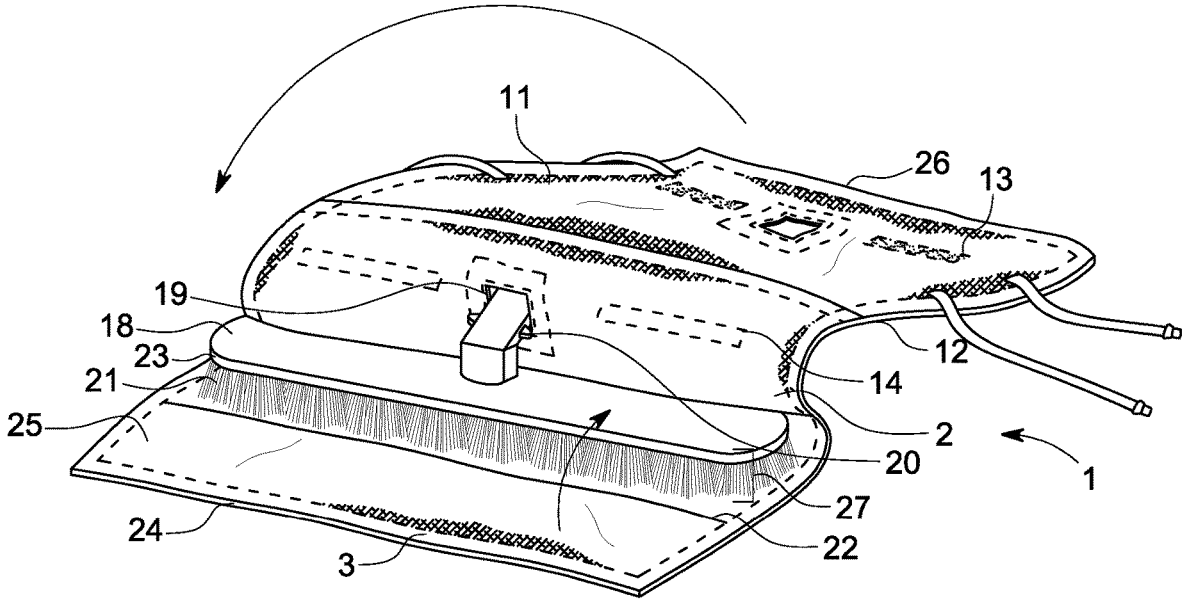
FIG. 9 provides a perspective view of an embodiment of the present disclosure being mounted to a pool cleaning attachment head.

The method of mounting the device 1 to an attachment head 18 for a pool cleaning pole comprises a similar set of steps, regardless of which embodiment is utilized. As shown in FIG. 9, the first step required for mounting the device 1 to an attachment head 18 requires a first button hole 19 of the device 1 to be aligned with a neck or stem 20 of the attachment head 18. In this embodiment, the attachment head 18 is a brush comprising bristles 21. In this embodiment, the device 1 comprises an indicator line 22 on a first portion 24 of the device 1, and the method requires aligning the edge 23 of the attachment head 18 with the indicator line 22 before aligning the first button hole 19 with the stem 20. In this embodiment, aligning the edge 23 of the attachment head 18 with the indicator line 22 requires aligning the bristles 21 with the line 22. Also in this embodiment, in order to be visible, the indicator line 22 comprises a different color than the rest of the fabric 2. In other embodiments, the indicator line may be visible by a different stitching pattern or a combination of a different stitching pattern and different color than the rest of the fabric without straying from the scope of the present disclosure.

In this embodiment, and still referring to FIG. 9, the indicator line 22 is offset from a line of stitches 3 on the edge of the first portion 24, which defines a segment 25 in between the indicator line 22 and the stitches 3 on the edge of the first portion 24. After aligning both the edge 23 of the attachment head 18 with the indicator line 22 and the first button hole 19 with the stem 20, the method then comprises folding the segment 25 over the bristles 21. After folding the segment 25 over the bristles 21, the method then requires wrapping the second portion 26 around the attachment head 18 while, preferably, maintaining contact between the segment 25 and the bristles 21. While the attachment head 18 is a brush in this embodiment, the attachment head 18 may be a different pool cleaning tool in other embodiments without straying from the scope of the present disclosure. However, regardless of the embodiment, it is preferable that the attachment head 18 has a raised leading face 27 to catch sediment that is displaced or kicked up during the cleaning process. In the preferred embodiment a raised leading face 27 has a height of at least three inches (3"), which may be considered critical for catching displaced sediment.

Figure 10:
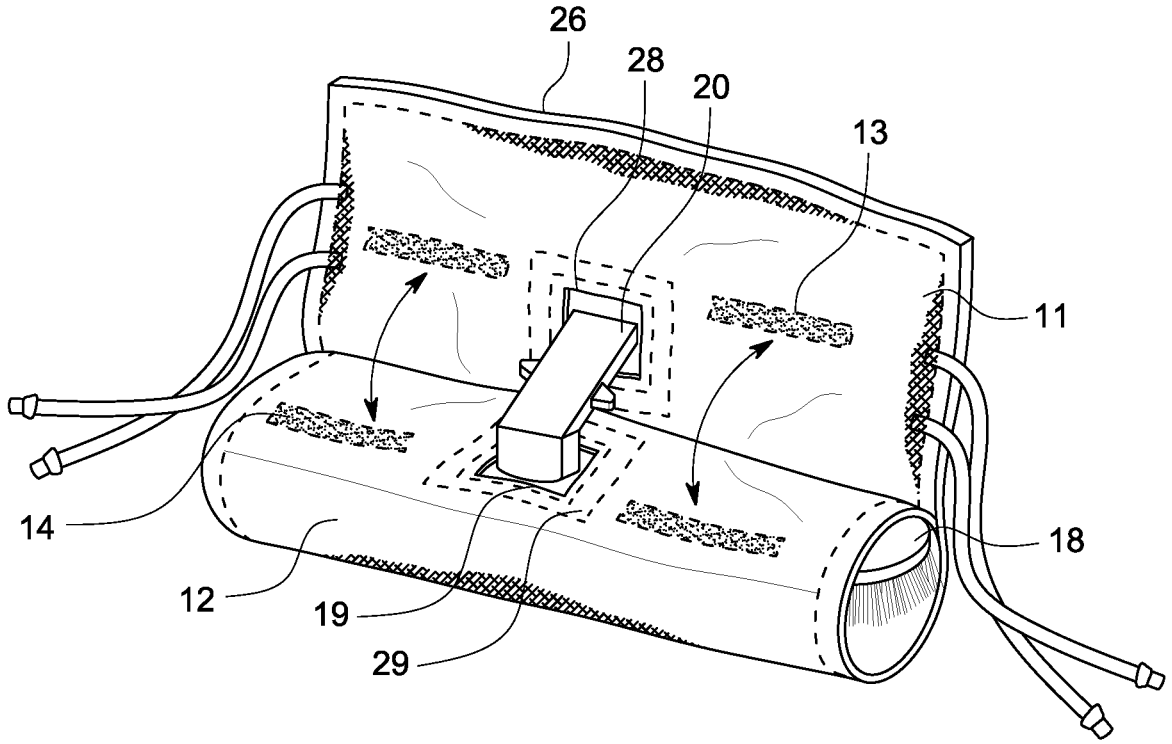
FIG. 10 provides a perspective view of an embodiment of the present disclosure being double wrapped around a pool cleaning attachment head.

Also shown in FIGS. 9 and 10, a first or front face 11 of the device 1 comprises a plurality of hook patches 13, and a second, opposite, rear face 12 of the device 1 comprises a corresponding number of loop patches 14. In this way, once the second portion 26 is wrapped around the attachment head 18, the hook patches 13 on the first face 11 can be attached to the loop patches 14 on the second, opposite face 12, as shown in FIG. 10. Also shown in FIG. 10, after the second portion 26 is properly wrapped around the attachment head 18, the second button hole 28 aligns with the stem 20.

Figure 11:
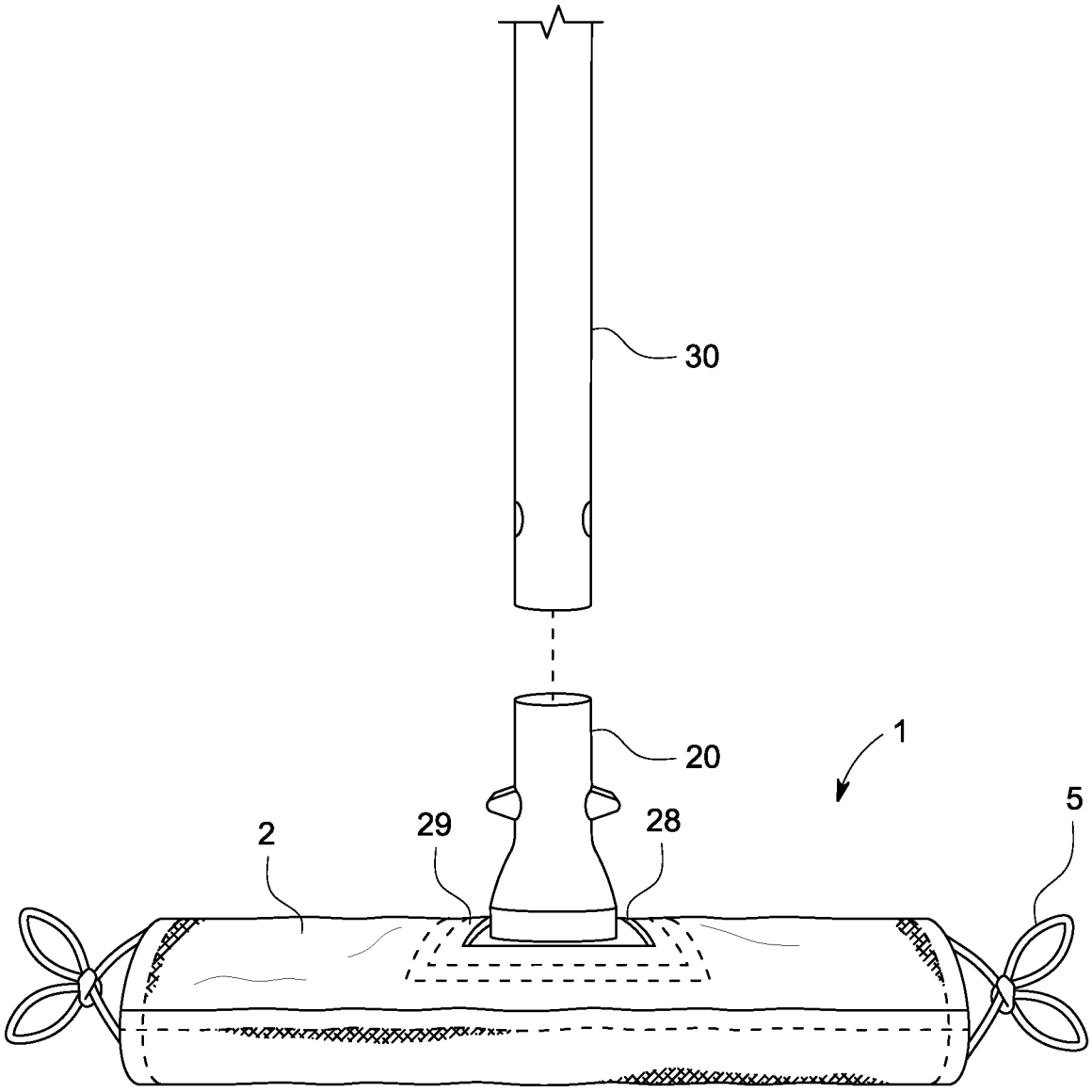
FIG. 11 provides a perspective view of an embodiment of the present disclosure being fully mounted to a pool cleaning attachment head.

Once the hook patches 13 are fastened to the loop patches 14, the first and second button holes 19 and 28 will be layered on top of each other with the stem 20 extending through them, as shown in FIG. 11. The final steps of the method for mounting the device 1 to the attachment head 18 for a pool cleaning pole 30 comprise tying the strings 5 for lateral or horizontal stability, and attaching the neck or stem 20 of the attachment head 18 to the pool cleaning pole 30. In the embodiment illustrated in FIGS. 9, 10, and 11 the button holes 19 and 28 improve both vertical and horizontal stability by being reinforced by double seamed and double faced stitching 29. As previously mentioned, this special type of stitching 29, which makes the button holes 19 and 28 comparably more stiff than the surrounding fabric 2. This feature ensures that the movements of the device 1 are consistent and controlled when in use, despite the unpredictable dynamics of the movement of fabric 2 in water. In one embodiment, in addition to providing reinforced button holes 19, an elastic strip may be attached across the edge of one of the portions 24 or 26 to provide additional stability when the device 1 is properly folded and mounted to the stem 20 of an attachment head 18. In such an embodiment, the elastic strip may be attached to the edges of the first portion 24 or second portion 26 by stitching and may wrap around or over the stem 20 to further secure the device 1 to the attachment head 18.

In the embodiment shown in FIG. 11, the device 1 is properly double wrapped. Double wrapping of the device 1 is preferred over the device 1 having a thick, single layer of fabric 2. The reason for this is that double wrapping of the device 1 creates two separate layers of fabric 2, and thus more surface area for sediment to be spread and absorbed on. When the device 1 is unraveled and dismounted from the pole 30 and attachment head 18 after cleaning the surfaces of a pool, the sediment is spread across two layers of fabric 2, as opposed to being trapped in a single, thick layer, thus making the device 1 easier to clean.

Before it is necessary to clean the device 1, the device 1 must first be used to clean a pool. In a preferred embodiment, the device 1 is only used to clean the smooth surfaces of pools or other smooth surfaces. Examples of smooth surfaces that may be cleaned with the device 1 include, but are not limited to, a vinyl liner, fiberglass, and the like. More examples of smooth surfaces that may be cleaned by the device 1 include indoor tile or hardwood floors, and even the surfaces of coy ponds. The reason that the preferred use of the device 1 is the cleaning of smooth surfaces is because if the device 1 is used to clean surfaces with a rougher surface finish than material like vinyl or fiberglass, the fabric 2 of the device 1 may get caught on the rough material decrease the effectiveness of the fabric 2 over time or simply cause the device 1 to rip and become unusable without repair.

In one embodiment, and still referring to FIG. 11, the method of using the device 1 to clean the surface of a pool comprises the steps of maneuvering the device 1 over areas on the surface where sediment has accumulated. When mounted to the pool cleaning pole 30 and attachment head 18 correctly, the device 1 will collect the majority of sediment in an area without creating a cloud of dirt in the water, as using an attachment head 18 without the device 1 attached would inevitably do. By collecting the majority of sediment on the first pass without creating a cloud of dirt, the device 1 may contribute to increasing the useable life of a pool filter. After using the device 1 for cleaning, it may be desirable to remove accumulated sediment from the device 1 before repeated use. In order to remove the device 1 from the pole 30 and attachment head 18 the method requires reversing the steps discussed in reference to FIGS. 9, 10, and 11 (e.g., removing the attachment head 18 from the pole 30, untying the strings 5, unfastening the hook and loop patches 13 and 14, etc.).

Figure 12:
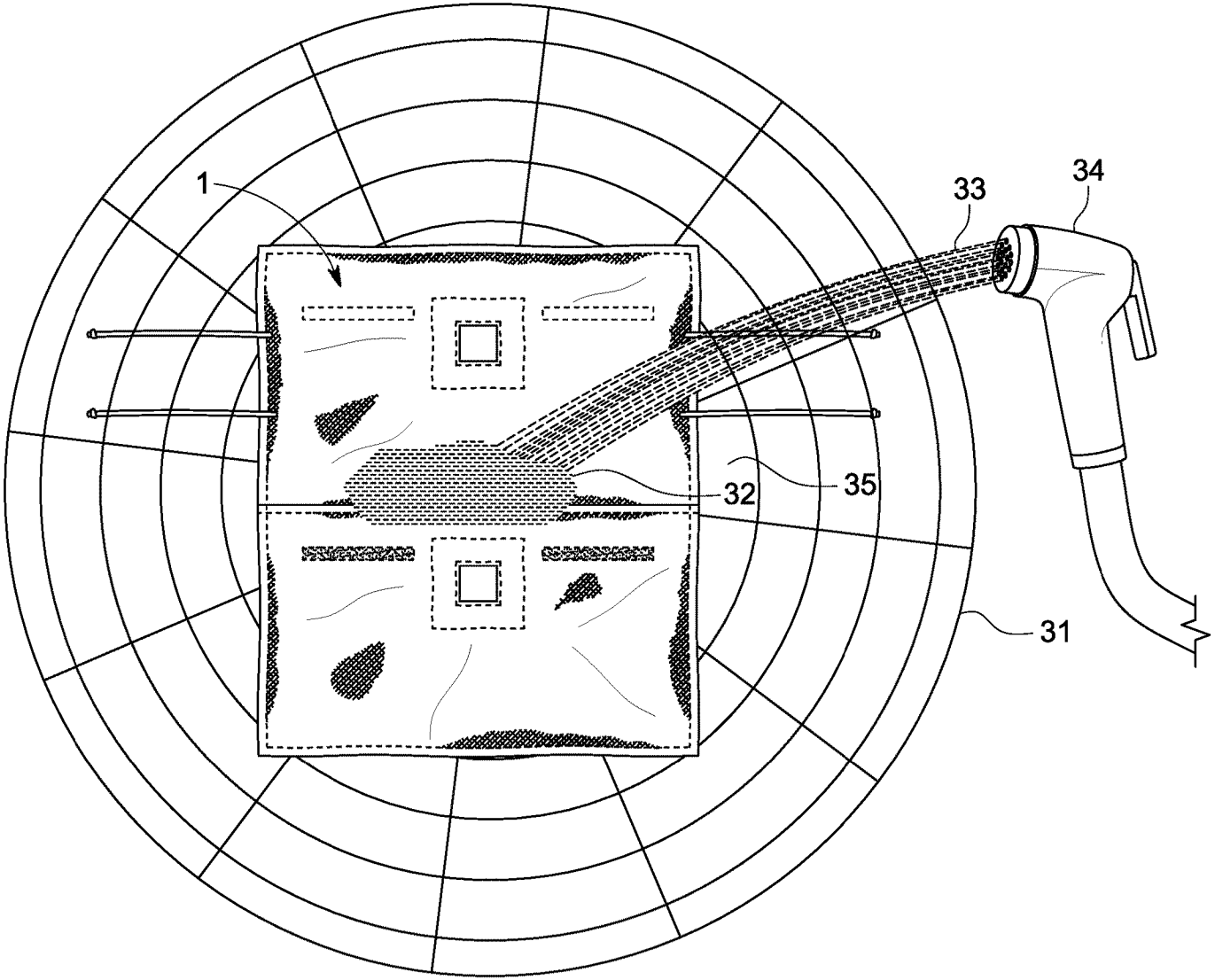
FIG. 12 provides a perspective view of an embodiment of the present disclosure being unraveled and cleaned.

In one embodiment, referring now to FIG. 12, the device 1 may be cleaned by laying the device 1 flat on a porous object 31, such as an outdoor table (as shown in FIG. 12), chair, and the like. In the embodiment shown in FIG. 12, the sediment 32 is then removed from the device 1 by spraying water 33 from a garden hose 34 on the sediment 32. It is preferred that the water 33 used to remove the sediment 32 is pressurized. No more pressure than the pressure from a standard garden hose 34 should be required. Because the device 1 is placed on a porous object 31, rinsing the device 1 with high pressure water 33 will cause sediment 32 to flow out of the device 1 through the pores 35 of the object 31. Once all sediment 32 is removed, the device 1 may be left outside to dry. In another embodiment, the device may be washed and dried in the laundry without straying from the scope of present disclosure.

While several variations of the present disclosure have been illustrated by way of example in preferred or particular embodiments, it is apparent that further embodiments could be developed within the spirit and scope of the present disclosure, or the inventive concept thereof. However, it is to be expressly understood that elements described in one embodiment may be incorporated with any other embodiment in combination with any other elements disclosed herein in the various embodiments. It is also to be expressly understood that any modifications and adaptations to the present disclosure are within the spirit and scope of the present disclosure, and are inclusive, but not limited to the following appended claims as set forth.

What is claimed is:

1. A system comprising:

a device comprising:

a fabric having a first portion and a second portion;

a first plurality of stitches on an edge of the first portion and the second portion;

a first face and a second face, wherein the first face comprises a plurality of strings attached to the fabric by a second plurality of stitches; and a button hole on at least one of the first portion or the second portion; and the system further comprising an attachment head for a pool cleaning pole;

wherein the device is wrapped around the attachment head, and the attachment head is attached to the pool cleaning pole;

wherein the device further comprises a second button hole on at least one of the first portion or the second portion;

wherein the button hole is layered on top of the second button hole, and a stem of the attachment head extends through both the button hole and the second button hole.

2. The system of claim 1 wherein the attachment head comprises a stem, the stem being attached to the pool cleaning pole.

3. The system of claim 2 wherein the stem extends through the button hole.

4. The system of claim 1 wherein the plurality of strings are tied in order to provide lateral stability to the device.

5. The system of claim 1 wherein the device further comprises a hook patch and a loop patch.

6. The system of claim 5 wherein the hook patch and the loop patch are mated and attached to opposite faces of the device.

7. The system of claim 1 wherein the button hole is reinforced by a double seam and a double face stitching.

* * * * *